US007966874B2

(12) United States Patent
Hassan et al.

(10) Patent No.: US 7,966,874 B2
(45) Date of Patent: Jun. 28, 2011

(54) MULTI-RESOLUTION BOREHOLE PROFILING

(75) Inventors: Gamal A. Hassan, Houston, TX (US); James V. Leggett, III, Magnolia, TX (US); Gavin Lindsay, Kuala Lumpur (MY); Philip L. Kurkoski, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 415 days.

(21) Appl. No.: 12/136,848

(22) Filed: Jun. 11, 2008

(65) Prior Publication Data

US 2008/0307875 A1 Dec. 18, 2008

Related U.S. Application Data

(63) Continuation-in-part of application No. 12/051,696, filed on Mar. 19, 2008, and a continuation-in-part of application No. 11/863,052, filed on Sep. 27, 2007, now Pat. No. 7,548,817.

(51) Int. Cl.
*G01V 1/48* (2006.01)
*E21B 47/14* (2006.01)

(52) U.S. Cl. ..... 73/152.03; 73/152.45; 702/9

(58) Field of Classification Search ..... 73/152.03, 73/152.05, 152.43, 152.46; 702/7, 9
See application file for complete search history.

(56) References Cited

U.S. PATENT DOCUMENTS 4,346,460 A 8/1982 Schuster
4,858,130 A 8/1989 Widrow
5,017,778 A * 5/1991 Wraight ..... 250/254
5,081,613 A * 1/1992 Holzhausen et al. ..... 367/86
5,200,705 A * 4/1993 Clark et al. ..... 324/338
5,335,209 A 8/1994 Jaenke et al.
5,416,750 A 5/1995 Doyen et al.
5,638,337 A 6/1997 Priest
5,640,371 A 6/1997 Schmidt et al.
5,678,643 A * 10/1997 Robbins et al. ..... 175/45
5,737,277 A 4/1998 Priest
5,987,385 A * 11/1999 Varsamis et al. ..... 702/6
6,175,536 B1 1/2001 Khan
6,237,404 B1 * 5/2001 Crary et al. ..... 73/152.03
6,302,845 B2 10/2001 Shi et al.
6,307,199 B1 * 10/2001 Edwards et al. ..... 250/269.3
6,584,837 B2 7/2003 Kurkoski
6,673,016 B1 1/2004 Bolorforosh et al.
6,842,400 B2 1/2005 Blanch et al.

(Continued)

FOREIGN PATENT DOCUMENTS

WO 2007058899 A1 5/2007

(Continued)

OTHER PUBLICATIONS

Chang et al.; "Localized Maps of Subsurface", Oilfield Review, 1998, pp. 56-66.

(Continued)

*Primary Examiner* — John Fitzgerald
(74) *Attorney, Agent, or Firm* — Mossman Kumar & Tyler PC

(57) ABSTRACT

Harmonics and subharmonics of acoustic measurements made during rotation of a sensor on a downhole are processed to estimate the location of the imager, and size and shape of the borehole. A piecewise elliptical fitting procedure may be used. These estimates may be used to correct measurements made by a standoff-sensitive formation evaluation sensor such as a neutron porosity tool.

19 Claims, 9 Drawing Sheets

U.S. PATENT DOCUMENTS

| | | | | |
|---|---|---|---|---|
| 6,868,038 | B2 | 3/2005 | Leaney | |
| 6,898,967 | B2 * | 5/2005 | Macpherson | 73/152.05 |
| 7,000,700 | B2 | 2/2006 | Cairns et al. | |
| 7,272,504 | B2 * | 9/2007 | Akimov et al. | 702/9 |
| 7,295,928 | B2 * | 11/2007 | Hassan et al. | 702/9 |
| 7,301,338 | B2 | 11/2007 | Gillen et al. | |
| 7,301,852 | B2 * | 11/2007 | Leggett et al. | 367/32 |
| 7,327,145 | B2 * | 2/2008 | Haugland | 324/338 |
| 7,385,400 | B2 * | 6/2008 | Moore | 324/338 |
| 2002/0008197 | A1 * | 1/2002 | Mickael | 250/269.2 |
| 2004/0158997 | A1 * | 8/2004 | Tang | 33/304 |
| 2005/0093546 | A1 | 5/2005 | Banning et al. | |
| 2006/0096105 | A1 | 5/2006 | Haugland | |
| 2006/0106541 | A1 | 5/2006 | Hassan et al. | |
| 2008/0083872 | A1 | 4/2008 | Huiszoon | |

FOREIGN PATENT DOCUMENTS

| | | | |
|---|---|---|---|
| WO | 2008040030 | A2 | 4/2008 |

OTHER PUBLICATIONS

Brie et al.; "New Directions in Sonic Logging", Oilfield Review, 1998, pp. 40-55.

* cited by examiner

MULTI-RESOLUTION BOREHOLE PROFILING

CROSS-REFERENCES TO RELATED APPLICATIONS

This application claims priority as a continuation-in-part of U.S. patent application Ser. No. 12/051,696 of Hassan et al., filed on Mar. 13, 2008, which is a continuation-in-part of U.S. patent application Ser. No. 11/863,052 of Hassan et al, filed on Sep. 27, 2007, which claimed priority from U.S. Provisional Patent Application Ser. No. 60/847,948 filed on Sep. 28, 2006 and from U.S. Provisional Patent Application Ser. No. 60/849,962 filed on Oct. 6, 2006.

TECHNICAL FIELD OF THE PRESENT DISCLOSURE

The present disclosure relates generally to devices, systems, and methods of geological exploration in wellbores. More particularly, the present disclosure describes a device, a system, and a method useful for using harmonics and subharmonics of a signal produced by an acoustic transducer for determining a downhole formation evaluation tool position and borehole geometry in a borehole during drilling.

BACKGROUND OF THE PRESENT DISCLOSURE

A variety of techniques are currently utilized in determining the presence and estimation of quantities of hydrocarbons (oil and gas) in earth formations. These methods are designed to determine formation parameters, including, among other things, the resistivity, porosity, and permeability of the rock formation surrounding the wellbore drilled for recovering the hydrocarbons. Typically, the tools designed to provide the desired information are used to log the wellbore. Much of the logging is done after the wellbores have been drilled. More recently, wellbores have been logged while drilling, which is referred to as measurement-while-drilling (MWD) or logging-while-drilling (LWD). One advantage of MWD techniques is that the information about the rock formation is available at an earlier time when the formation is not yet damaged by an invasion of the drilling mud. Thus, MWD logging may often deliver better formation evaluation (FE) data quality. In addition, having the formation evaluation (FE) data available already during drilling may enable the use of the FE data to influence decisions related to the ongoing drilling (such as geo-steering, for example). Yet another advantage is the time saving and, hence, cost saving if a separate wireline logging run can be avoided.

For an accurate analysis of some FE measurements, for example, neutron porosity (NP) measurements and/or neutron density (ND) measurements, and the like, it is important to know the actual downhole formation evaluation (FE) tool position in a borehole during drilling. By way of example, an 8-sector azimuthal caliper with 16 radii allows the determination of the exact center of the downhole formation evaluation (FE) tool in the borehole during drilling and a magnetometer allows the determination of the exact orientation of the detector face. These two parameters allow optimization of the environmental borehole effects, such as correction for borehole size and mud.

However, conventional corrections typically assume one of two conditions. Either (1) the downhole formation evaluation (FE) tool is eccentered (the FE tool center is eccentrically located with respect to the "true" center of the borehole and the FE tool center does not coincide with the true center of the borehole), and appropriate eccentered FE tool corrections are used, or (2) the downhole formation evaluation (FE) tool is centered (the FE tool center is not eccentrically located with respect to the true center of the borehole and the FE tool center does coincide with the true center of the borehole) and appropriate centered FE tool corrections are used.

In the eccentered case, conventionally an average eccentered correction for constant rotation of the FE tool is assumed whereby the FE tool is assumed to face the formation about 50% of the time and to face into the borehole about 50% of the time. However, the conventional approaches are not able to allow the selection of the proper environmental corrections to apply generally, lacking any way to track the FE tool center and direction with respect to the borehole center. For a non-azimuthal FE tool, for example, the conventional approaches lack any way to extrapolate between (1) the eccentered and (2) the centered cases described above, even assuming constant FE tool rotation.

While it has long been known that two-way travel time of an acoustic signal through a borehole contains geometric information about the borehole, methods of efficiently obtaining that geometric information acoustically continue to need improvement. In particular, a need exists for efficient ways to obtain such geometric information about a borehole to overcome, or at least substantially ameliorate, one or more of the problems described above. U.S. patent application Ser. No. 12/051,696 of Hassan et al., discloses a method and apparatus for evaluating an earth formation. The method includes conveying a logging string into a borehole, making rotational measurements using an imaging instrument of a distance to a wall of the borehole, processing the measurements of the distance to estimate a geometry of the borehole wall and a location of the imaging instrument in the borehole. The method further includes estimating a value of a property of the earth formation using a formation evaluation sensor, the estimated geometry and the estimated location of the imaging instrument. The method may further include measuring an amplitude of a reflected acoustic signal from the wall of the borehole. The method may further include estimating a standoff of the formation evaluation sensor and estimating the value of the property of the earth formation using the estimated standoff. Estimating the geometry of the borehole may further include performing a least-squares fit to the measurements of the distance. Estimating the geometry of the borehole may further include rejecting an outlying measurement and/or defining an image point when the measurements of the distance have a limited aperture. The method may further include providing an image of the distance to the borehole wall. The method may further include providing a 3-D view of the borehole, identifying a washout and/or identifying a defect in the casing. The method may further include using the estimated geometry of the borehole to determine a compressional-wave velocity of a fluid in the borehole. The method may further include binning the measurements made with the formation evaluation sensor.

One problem not discussed in Hassan is that of improving the signal-to-noise ratio of the reflected acoustic signals. It is well-known that the borehole mud is attenuative and dispersive. As a result of this, the reflected signals may be relatively weak and fairly narrow band, resulting in poor resolution. In addition, cuttings may be present in the mud and produce spurious reflections. Hassan uses a statistical method to identify and remove these spurious reflections. It would be desirable to have a method of imaging borehole walls and producing a borehole profile that can achieve good resolution and good signal to noise over a wide range of distances. The present disclosure addresses this need.

SUMMARY OF THE PRESENT DISCLOSURE

One embodiment of the disclosure is a method of evaluating an earth formation. The method includes conveying an acoustic sensor on a downhole assembly into a borehole, making measurements at a plurality of azimuthal angles of a distance to a wall of the borehole, the measurements including measurements at least one of: (I) a harmonic of a fundamental frequency of the acoustic sensor, and (II) a subharmonic of a fundamental frequency of the acoustic sensor, and processing the measurements to estimate a geometry of the borehole. The method may further include using a measurement of the distance to the borehole wall and the estimated geometry of the borehole to estimate a location of the downhole assembly in a cross-section of the borehole. Making measurements at the plurality of azimuthal angles may be done by rotating the acoustic sensor, and/or using a beam steering of the acoustic sensor. The method may further include estimating a standoff of a formation evaluation (FE) sensor on the downhole assembly, making measurements of a property of the formation with the FE sensor on the downhole assembly, and estimating a value of the property of the earth formation using the estimated standoff and the measurements made by the FE sensor. The method may further include using the measurements for identifying a drill cutting in a fluid in the borehole. The method may further include providing an image of the borehole wall. The method may further include providing a 3-D view of the borehole, and/or identifying a washout. The method may further include selecting the fundamental frequency of the acoustic sensor based at least in part on a density of a fluid in the borehole.

Another embodiment of the disclosure is an apparatus for evaluating an earth formation. The apparatus includes a downhole assembly configured to be conveyed into a borehole, an acoustic sensor having a plurality of layers having a different acoustic impedance on the downhole assembly, the acoustic sensor being configured to make measurements at a plurality of azimuthal angles of a distance to a wall of the borehole. The apparatus also includes at least one processor configured to recover from the measurements a signal including at least one of: (A) a harmonic of a fundamental frequency of the acoustic sensor, and (B) a subharmonic of a fundamental frequency of the acoustic sensor, and use the recovered signals to estimate a geometry of the borehole. The at least one processor may be further configured to use a measurement of the distance to the borehole wall and the estimated geometry of the borehole to estimate a location of the downhole assembly in a cross-section of the borehole. The apparatus may further include a formation evaluation (FE) sensor on the downhole assembly configured to make measurements of a property of the formation at the plurality of azimuthal angles, wherein the at least one processor is further configured to estimate a standoff of the formation evaluation (FE) sensor, and estimate a value of the property of the earth formation using the estimated standoff and the measurements made by the FE sensor. The at least one processor may be further configured to use the measurements to identify a drill cutting in a fluid in the borehole. The at least one processor may be further configured to provide an image of the distance to the borehole wall. The at least one processor may be further configured to provide a 3-D view of the borehole, and/or identify a washout. The downhole assembly may be a bottomhole assembly configured to be conveyed on a drilling tubular, and/or a logging string configured to be conveyed on a wireline. The acoustic sensor may be configured to make measurements at the plurality of azimuthal angles by rotation of the sensor, and/or beam-steering of the sensor.

Another embodiment of the disclosure is a computer readable medium for use with an apparatus for evaluating an earth formation. The apparatus includes a downhole assembly configured to be conveyed into a borehole, and an acoustic sensor on the downhole assembly, the acoustic sensor comprising a plurality of layers having a different acoustic impedance, the acoustic sensor being configured to making measurements at a plurality of azimuthal angles of a distance to a wall of the borehole. The medium includes instructions that enable at least one processor to recover from the measurements a signal including a harmonic of a fundamental frequency of the acoustic sensor, and/or a subharmonic of a fundamental frequency of the acoustic sensor, and use the recovered signals to estimate a geometry of the borehole. The medium may include a ROM, an EPROM, an EEPROM, a flash memory, and/or an optical disk.

BRIEF DESCRIPTION OF THE DRAWINGS

The present disclosure is best understood with reference to the accompanying figures in which like numerals refer to like elements and in which.

DETAILED DESCRIPTION OF ILLUSTRATIVE EMBODIMENTS

Illustrative embodiments of the present disclosure are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

Figure 1:
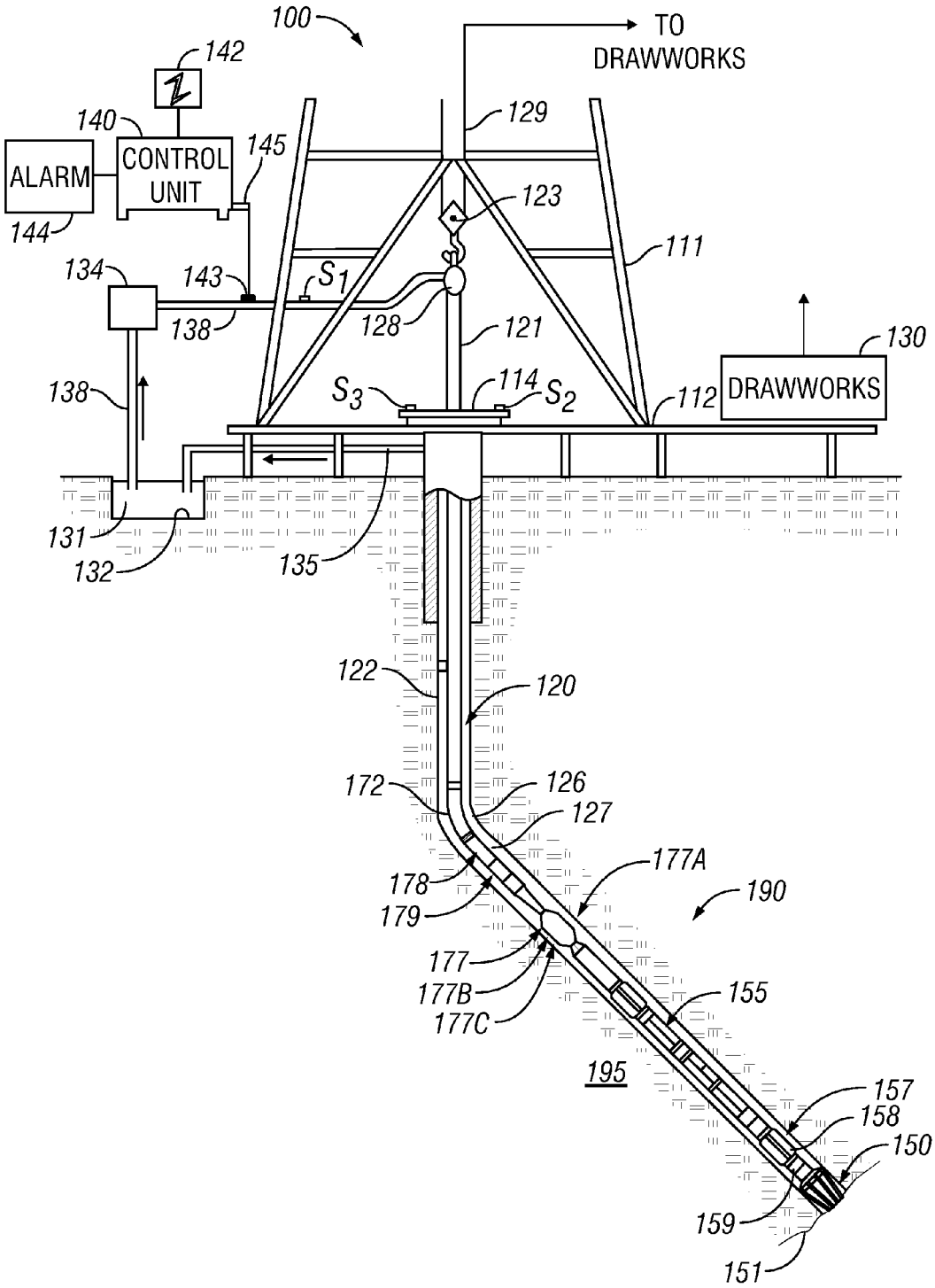
FIG. 1 schematically illustrates a drilling system suitable for use with the present disclosure.

Referring first to FIG. 1, a schematic diagram is shown of a drilling system 100 useful in various illustrative embodiments, the drilling system 100 having a drillstring 120 carrying a drilling assembly 190 (also referred to as a bottomhole assembly, or "BHA") conveyed in a "wellbore" or "borehole" 126 for drilling the wellbore 126 into geological formations 195. The drilling system 100 may include a conventional derrick 111 erected on a floor 112 that may support a rotary table 114 that may be rotated by a prime mover such as an electric motor (not shown) at a desired rotational speed. The drillstring 120 may include tubing such as a drill pipe 122 or a coiled-tubing extending downward from the surface into the borehole 126. The drillstring 120 may be pushed into the wellbore 126 when the drill pipe 122 is used as the tubing. For coiled-tubing applications, a tubing injector (not shown), however, may be used to move the coiled-tubing from a source thereof, such as a reel (not shown), to the wellbore 126. A drill bit 150 may be attached to the end of the drillstring 120, the drill bit 150 breaking up the geological formations 195 when the drill bit 150 is rotated to drill the borehole 126. If the drill pipe 122 is used, the drillstring 120 may be coupled to a drawworks 130 via a Kelly joint 121, a swivel 128, and a line 129 through a pulley 123. During drilling operations, the drawworks 130 may be operated to control the weight on the drill bit 150 or the "weight on bit," which is an important parameter that affects the rate of penetration (ROP) into the geological formations 195. The operation of the drawworks 130 is well known in the art and is thus not described in detail herein.

During drilling operations, in various illustrative embodiments, a suitable drilling fluid 131 (also known and/or referred to sometimes as "mud" or "drilling mud") from a mud pit (source) 132 may be circulated under pressure through a channel in the drillstring 120 by a mud pump 134. The drilling fluid 131 may pass from the mud pump 134 into the drillstring 120 via a desurger (not shown), a fluid line 138, and the Kelly joint 121. The drilling fluid 131 may be discharged downhole at a borehole bottom 151 through an opening (not shown) in the drill bit 150. The drilling fluid 131 may circulate uphole through an annular space 127 between the drillstring 120 and the borehole 126 and may return to the mud pit 132 via a return line 135. The drilling fluid 131 may act to lubricate the drill bit 150 and/or to carry borehole 126 cuttings and/or chips away from the drill bit 150. A flow rate and/or a mud 131 dynamic pressure sensor $S_1$ may typically be placed in the fluid line 138 and may provide information about the drilling fluid 131 flow rate and/or dynamic pressure, respectively. A surface torque sensor $S_2$ and a surface rotational speed sensor $S_3$ associated with the drillstring 120 may provide information about the torque and the rotational speed of the drillstring 120, respectively. Additionally, and/or alternatively, at least one sensor (not shown) may be associated with the line 129 and may be used to provide the hook load of the drillstring 120.

The drill bit 150 may be rotated by only rotating the drill pipe 122. In various other illustrative embodiments, a downhole motor 155 (mud motor) may be disposed in the bottomhole assembly (BHA) 190 to rotate the drill bit 150 and the drill pipe 122 may be rotated usually to supplement the rotational power of the mud motor 155, if required, and/or to effect changes in the drilling direction. In various illustrative embodiments, electrical power may be provided by a power unit 178, which may include a battery sub and/or an electrical generator and/or alternator generating electrical power by using a mud turbine coupled with and/or driving the electrical generator and/or alternator. Measuring and/or monitoring the amount of electrical power output by a mud generator included in the power unit 178 may provide information about the drilling fluid (mud) 131 flow rate.

The mud motor 155 may be coupled to the drill bit 150 via a drive shaft (not shown) disposed in a bearing assembly 157. The mud motor 155 may rotate the drill bit 150 when the drilling fluid 131 passes through the mud motor 155 under pressure. The bearing assembly 157 may support the radial and/or the axial forces of the drill bit 150. A stabilizer 158 may be coupled to the bearing assembly 157 and may act as a centralizer for the lowermost portion of the mud motor 155 and/or the bottomhole assembly (BHA) 190.

A drilling sensor module 159 may be placed near the drill bit 150. The drilling sensor module 159 may contain sensors, circuitry, and/or processing software and/or algorithms relating to dynamic drilling parameters. Such dynamic drilling parameters may typically include bit bounce of the drill bit 150, stick-slip of the bottomhole assembly (BHA) 190, backward rotation, torque, shocks, borehole and/or annulus pressure, acceleration measurements, and/or other measurements of the drill bit 150 condition. A suitable telemetry and/or communication sub 172 using, for example, two-way telemetry, may also be provided, as illustrated in the bottomhole assembly (BHA) 190 in FIG. 1, for example. The drilling sensor module 159 may process the raw sensor information and/or may transmit the raw and/or the processed sensor information to a surface control and/or processor 140 via the telemetry system 172 and/or a transducer 143 coupled to the fluid line 138, as shown at 145, for example.

The communication sub 172, the power unit 178, and/or a formation evaluation (FE) tool 179, such as an appropriate measuring-while-drilling (MWD) tool, for example, may all be connected in tandem with the drillstring 120. Flex subs, for example, may be used in connecting the FE tool 179 in the bottomhole assembly (BHA) 190. Such subs and/or FE tools 179 may form the bottomhole assembly (BHA) 190 between the drillstring 120 and the drill bit 150. The bottomhole assembly (BHA) 190 may make various measurements, such as pulsed nuclear magnetic resonance (NMR) measurements and/or nuclear density (ND) measurements, for example, while the borehole 126 is being drilled. In various illustrative embodiments, the bottomhole assembly (BHA) 190 may include one or more formation evaluation and/or other tools and/or sensors 177, such as one or more acoustic transducers and/or acoustic detectors and/or acoustic receivers 177*a*, capable of making measurements of the distance of a center of the downhole FE tool 179 from a plurality of positions on the surface of the borehole 126, over time during drilling, and/or one or more mechanical or acoustic caliper instruments 177*b*.

A mechanical caliper may include a plurality of radially spaced apart fingers, each of the plurality of the radially spaced apart fingers capable of making measurements of the distance of the center of the downhole FE tool 179 from a plurality of positions on the borehole wall 126, over time during drilling, for example. An acoustic caliper may include one or more acoustic transducers which transmit acoustic signals into the borehole fluid and measure the travel time for acoustic energy to return from the borehole wall. In one embodiment of the disclosure, the transducer produces a collimated acoustic beam, so that the received signal may represent scattered energy from the location on the borehole wall where the beam impinges. In this regard, the acoustic caliper measurements are similar to measurements made by a mechanical caliper. The discussion of the disclosure below is based on such a configuration.

In an alternate embodiment of the disclosure, the acoustic transducer may emit a beam with wide angular coverage. In such a case, the signal received by the transducer may be a signal resulting from specular reflection of the acoustic beam at the borehole wall. The method of analysis described below would need to be modified for such a caliper.

Still referring to FIG. 1, the communication sub 172 may obtain the signals and/or measurements and may transfer the signals, using two-way telemetry, for example, to be processed on the surface, either in the surface control and/or processor 140 and/or in another surface processor (not shown). Alternatively, and/or additionally, the signals may be processed downhole, using a downhole processor 177*c* in the bottomhole assembly (BHA) 190, for example.

The surface control unit and/or processor 140 may also receive signals from one or more other downhole sensors and/or devices and/or signals from the flow rate sensor $S_1$, the surface torque sensor $S_2$, and/or the surface rotational speed sensor $S_3$ and/or other sensors used in the drilling system 100 and/or may process such signals according to programmed instructions provided to the surface control unit and/or processor 140. The surface control unit and/or processor 140 may display desired drilling parameters and/or other information on a display/monitor 142 that may be utilized by an operator (not shown) to control the drilling operations. The surface control unit and/or processor 140 may typically include a computer and/or a microprocessor-based processing system, at least one memory for storing programs and/or models and/or data, a recorder for recording data, and/or other peripherals. The surface control unit and/or processor 140 may typically be adapted to activate one or more alarms 144 whenever certain unsafe and/or undesirable operating conditions may occur.

Figure 2:
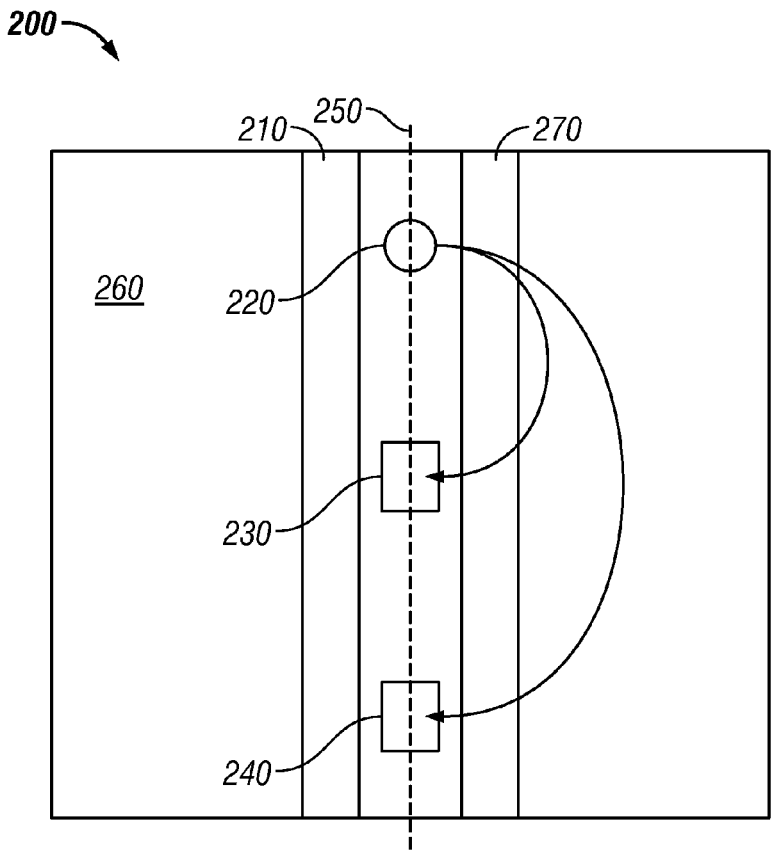
FIG. 2 schematically illustrates neutron porosity (NP) measurement techniques, according to the present disclosure.

In accordance with the present disclosure, a device, a system, and a method useful for determining the downhole formation evaluation (FE) tool 179 position in the borehole 126 during drilling are disclosed. The knowledge of this downhole FE tool 179 position in the borehole 126 can be used for improving certain formation evaluation (FE) measurement techniques, such as neutron porosity (NP) measurement techniques and/or neutron density (ND) measurement techniques, and the like. As shown in FIG. 2, for example, neutron porosity (NP) measurement techniques may be schematically illustrated, as shown generally at 200. A neutron porosity (NP) FE tool 179, schematically illustrated at 210, may be disposed downhole in the borehole 126, which may be an open borehole, as illustrated schematically at 250, for example. The NP tool 210 may include a neutron source 220, a near neutron detector 230, nearer to the neutron source 220, and a far neutron detector 240, farther away from the neutron source 220. The neutron source 220, the near neutron detector 230, and the far neutron detector 240 may be disposed along a central axis of the borehole 250.

The neutron source 220 may be arranged to produce neutrons that penetrate into a formation 260 near the open borehole 250, which may be surrounded by drilling mud 270, for example, some portion of the neutrons interacting with the formation 260 and then subsequently being detected by either the near neutron detector 230 or the far neutron detector 240. The neutron counting rates detected at the near neutron detector 230 may be compared with the neutron counting rates detected at the far neutron detector 240, for example, by forming an appropriate counting rate ratio. Then, the appropriate counting rate ratio obtained by the NP tool 210 may be compared with a respective counting rate ratio obtained by substantially the same NP tool 210 (or one substantially similar thereto) under a variety of calibration measurements taken in a plethora of environmental conditions such as are expected and/or likely to be encountered downhole in such an open borehole 250 (as described in more detail below).

Figure 3:
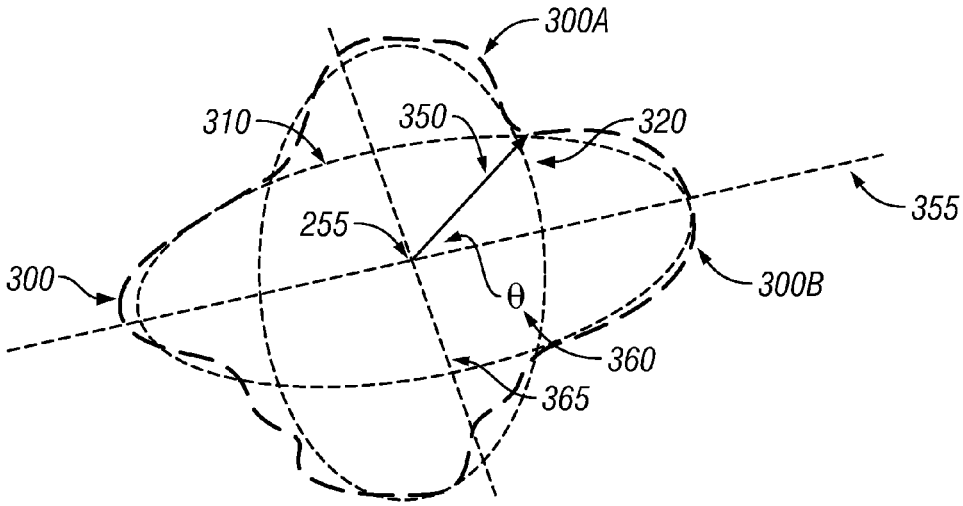
FIG. 3 illustrates the piecewise elliptical fit to the borehole wall.

The basic methodology used in the present disclosure assumes that the borehole has an irregular surface, and approximates it by a piecewise elliptical surface. This is generally shown by the surface 300 in FIG. 3. The center of the tool is at the position indicated by 255. The distance 350 from the center of the tool to the borehole wall is measured by a caliper as the tool rotates. In the example shown, the borehole wall may be approximated by two ellipses denoted by 310 and 320. The major axes of the two ellipses are denoted by 355 and 365 respectively. The points 300*a*, 300*b* are exemplary points on the borehole wall at which distance measurements are made.

Figure 4:
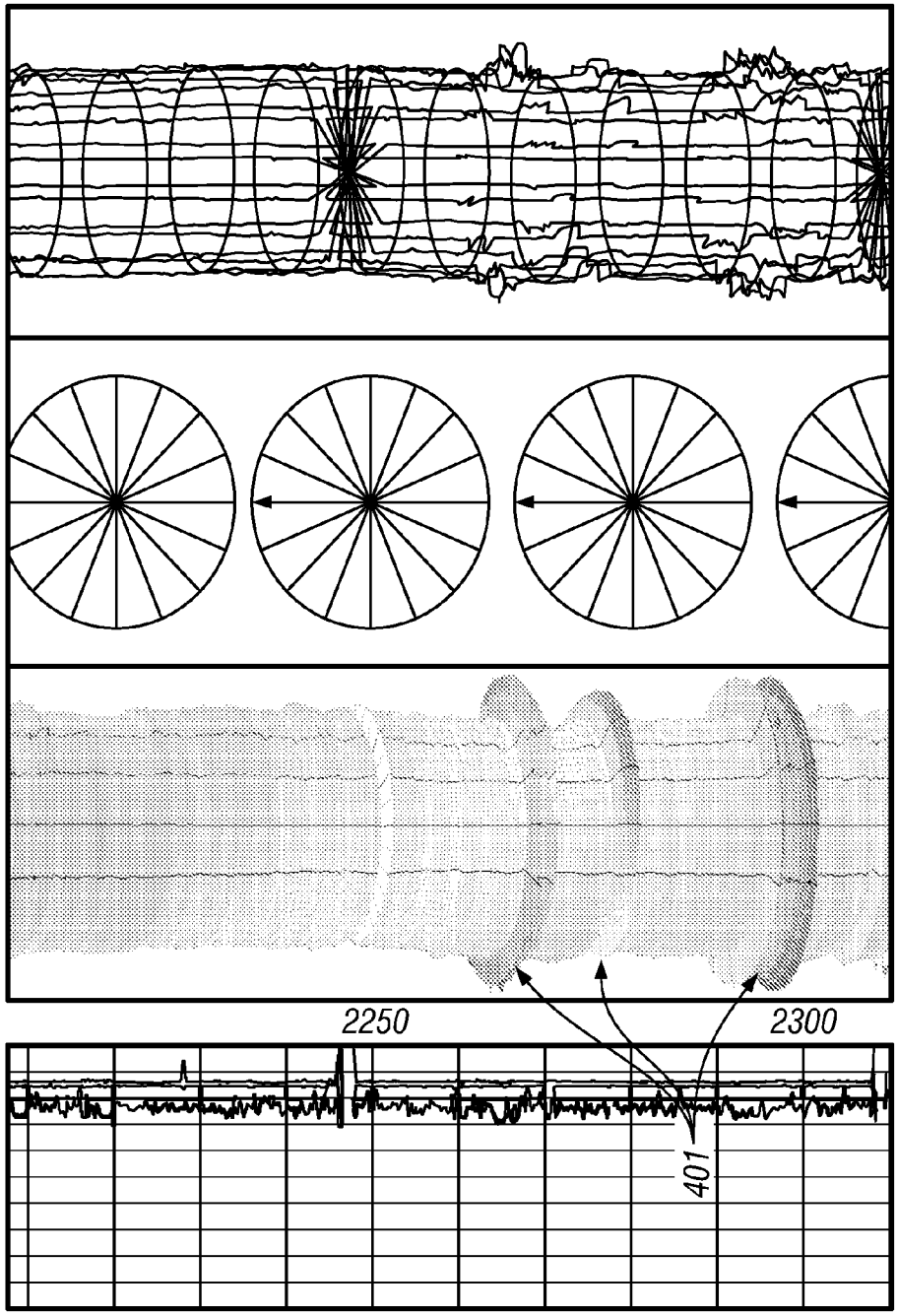
FIG. 4 illustrates a display of a 3-D profile of the borehole using the method of the present disclosure.

As discussed in Hassan '696, the borehole geometry and the location of the tool in the borehole are estimated using a piecewise elliptical fit. Estimating the geometry of the borehole may further include rejecting an outlying measurement and/or defining an image point when the measurements of the distance have a limited aperture. The method may further include providing an image of the distance to the borehole wall. The method may further include providing a 3-D view of the borehole ("borehole profile"), identifying a washout and/or identifying a defect in the casing. FIG. 4 shows a borehole profile constructed from the individual scans. The vertical axis here is the drilling depth. The right track of the figure shows a series of cross sections of the borehole. The middle track shows the 3-D view and zones of washouts such as 401 are readily identifiable.

Figure 5:
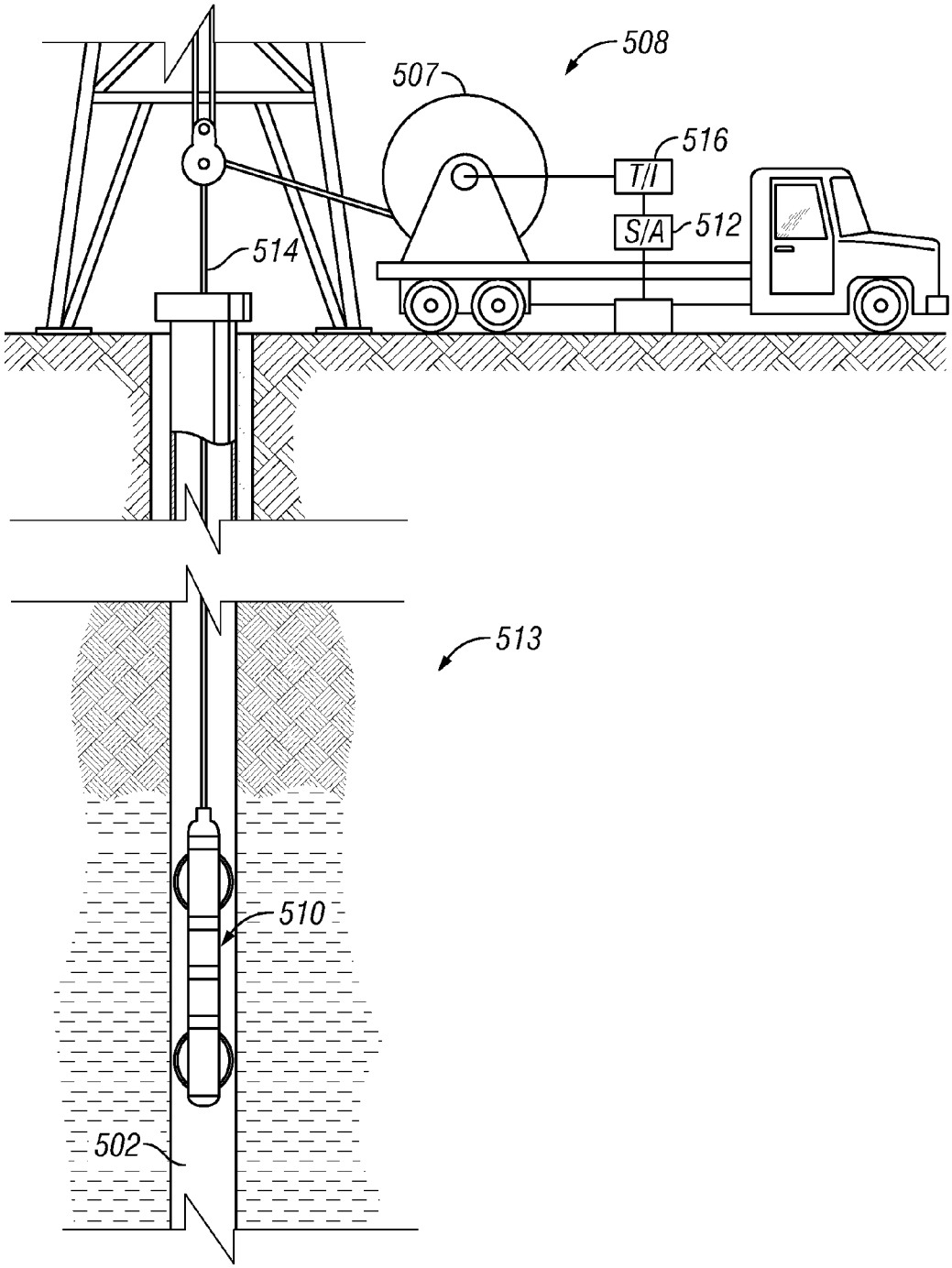
FIG. 5 shows an imaging well logging instrument disposed in a wellbore drilled through earth formations.

Referring to FIG. 5, an alternate system for borehole profiling is shown. The well logging instrument 510 is shown being lowered into a wellbore 502 penetrating earth formations 513. The instrument 510 can be lowered into the wellbore 502 and withdrawn therefrom by an armored electrical cable 514. The cable 514 can be spooled by a winch 507 or similar device known in the art. The cable 514 is electrically connected to a surface recording system 508 of a type known in the art which can include a signal decoding and interpretation unit 506 and a recording unit 512. Signals transmitted by the logging instrument 510 along the cable 514 can be decoded, interpreted, recorded and processed by the respective units in the surface system 508.

Figure 6A:
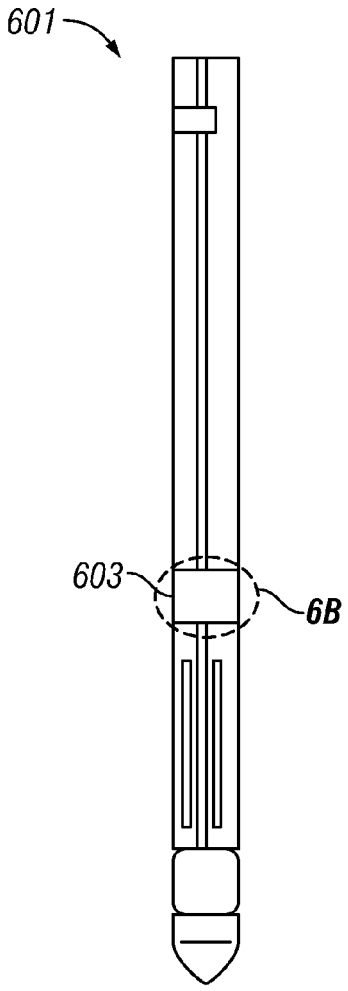
FIG. 6A shows the rotator assembly.
Figure 6B:
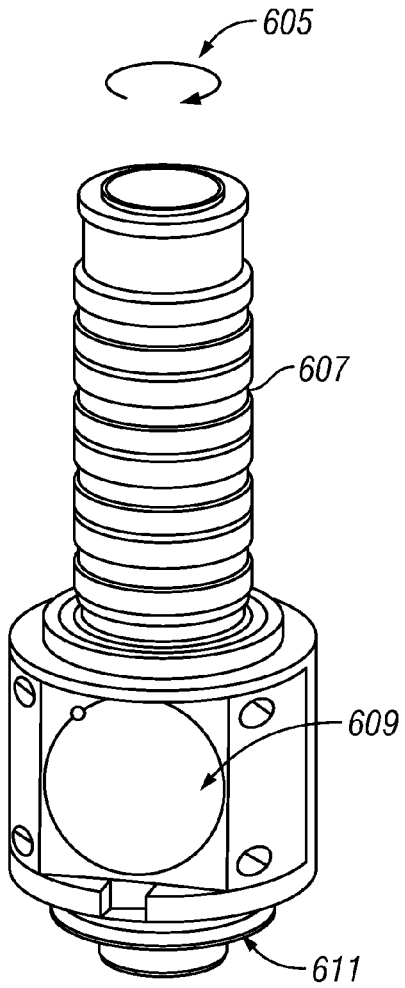
FIG. 6B shows the transducer assembly.

FIG. 6A shows mandrel section 601 of an exemplary imager instrument with a Teflon® window 603. Shown in FIG. 6B is a rotating platform 605 with an ultrasonic transducer assembly 609. The rotating platform is also provided with a magnetometer 611 to make measurements of the orientation of the platform and the ultrasonic transducer. The platform is provided with coils 607 that are the secondary coils of a transformer that are used for communicating signals from the transducer and the magnetometer to the non-rotating part of the tool.

The device discussed in FIGS. 6A-6B is commonly referred to as a borehole televiewer. It functions in a manner similar to the caliper discussed above by measuring transit times from the transducer to the borehole wall and back, and by measuring amplitudes of the received signals. For the purposes of this disclosure, we use the term "downhole assembly" to include both a BHA assembly conveyed on a drilling tubular as well as a wireline-conveyed logging instrument or string of logging instruments. While many wireline conveyed logging strings include a centralizer, this is not always the case, so that the televiewer signals may suffer from the same problems as the caliper measurements on a BHA.

Figure 7:
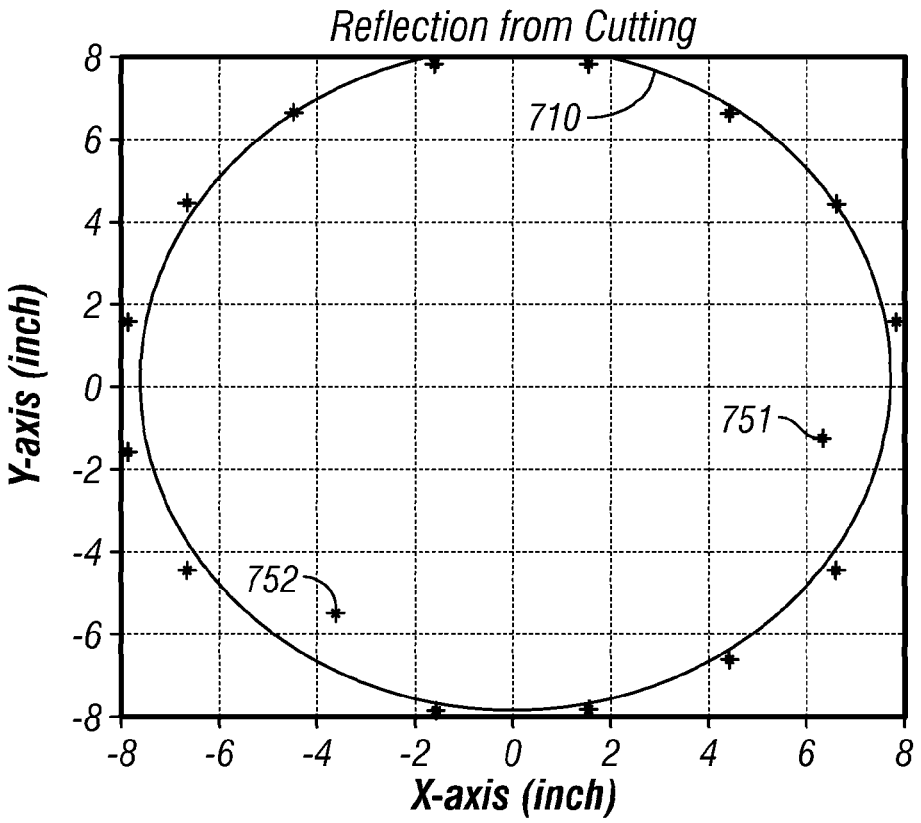
FIG. 7 shows an illustrative example of a reflection from a drill cutting.

One problem encountered in the data is illustrated in FIG. 7. Shown in FIG. 7 are a set of data points of distances and an elliptical fit 710 to the entire set of points. The points labeled as 751 and 752 would be recognizable as outliers to one versed in the art. In the present disclosure, the outliers are defined as those which have a residual error more than twice the standard deviation of the fit, though other criteria could be used. When the outliers 851 and 852 are removed from the curve fitting, the best fit ellipse is believed to be a better representation of the borehole wall shape. This is discussed in Hassan. The cause of the reflections that give rise to the outliers is commonly drill cuttings. These are relatively large portions of the earth formation that have been removed by the drillbit and flushed up the borehole by drilling mud. The size of the drill cuttings has an important bearing on the quality of the acoustic imaging data and the selection of the wavelength of the acoustic signals.

Those versed in the art would recognize that if the acoustic wavelength is smaller than the size of the cutting, then the cutting will block the acoustic signal from ever reaching the borehole wall and be reflected back from the cutting towards the transducer. If, on the other hand, the acoustic wavelength if larger than the size of the cutting, the waves will "bend" around the obstructive cutting and insonify the borehole wall. However, selecting a signal with a longer wavelength (lower frequency) has the undesirable effect of reducing the resolution of the image of the borehole wall.

Figure 8A:
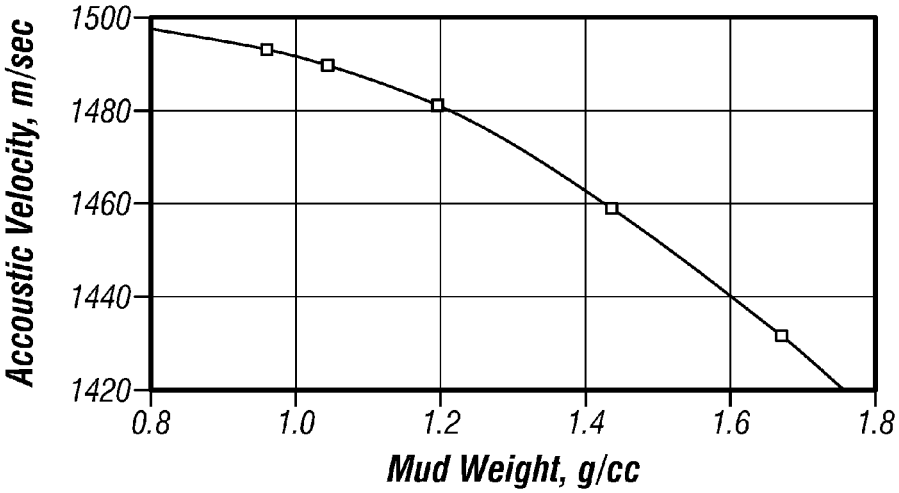
Figure 8A (Prior Art)
FIGS. 8A, 8B (prior art) shows the dependence of acoustic velocity on mud weight and the effect of mud weight on attenuation at difference frequencies.
Figure 8B:
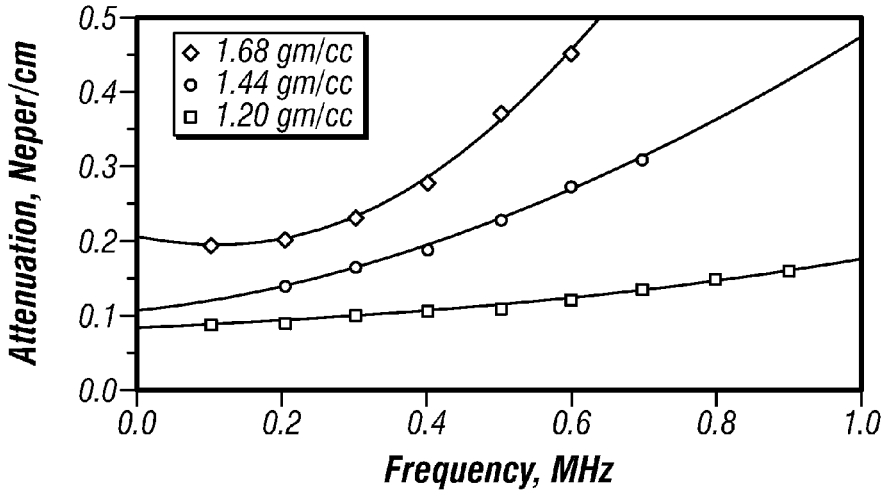
Figure 8B (Prior Art)

Mud weight also has a significant effect on the propagation of acoustic waves and the resolution of the images that can be obtained. FIGS. 8A and 8B show the dependence of acoustic velocity on mud weight and the effect of mud weight on attenuation at difference frequencies. Based on the mud weight expected to be used during drilling and the nominal size of the borehole, the present disclosure selects an appropriate frequency for the transducer to provide the necessary resolution of features on the borehole wall.

Figure 9:
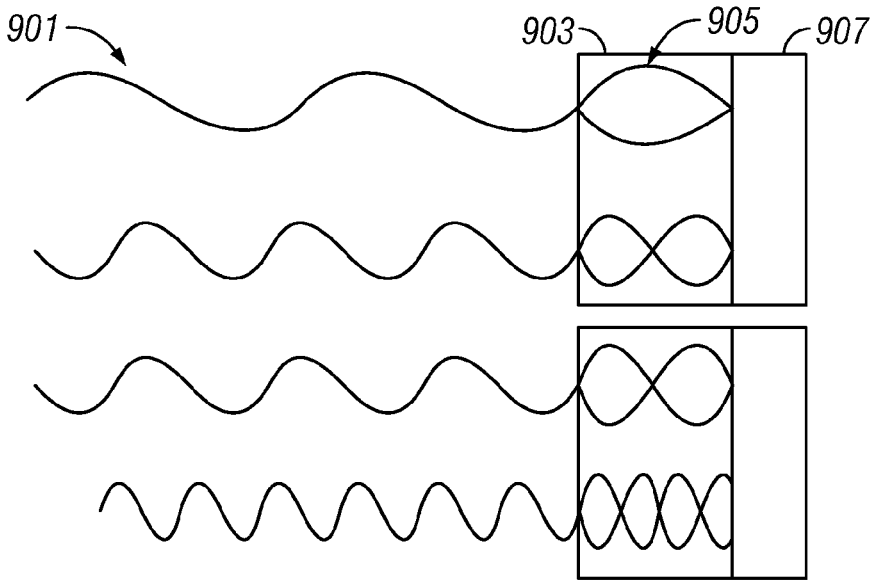
FIG. 9 shows harmonics of signals within a layered transducer.

Another aspect of the present disclosure is the use of harmonic signal processing using appropriately designed transducers to get measurements at multiple frequencies. The concept is illustrated in FIG. 9 where an exemplary transducer having two layers 903, 907 is shown. The number of layers is not to be construed as a limitation. The two layers have a significant difference in acoustic impedance. The method relies on the fact that reflected acoustic energy from the borehole wall (and any other reflector) in the borehole includes energy at the frequency of the generated acoustic wave (the fundamental frequency) as well as at harmonics of the fundamental frequency and the subharmonics of the fundamental frequency. In FIG. 9, a second harmonic 905 is shown in the layer 903 resulting from second harmonic components in the incoming wave 901. By properly selecting signals from the individual layers and their polarities, it is possible to get signals at harmonics as well as subharmonics of the fundamental frequency. See, for example, U.S. Pat. No. 6,673,016 to Bolorforosh et al.

Figure 10:
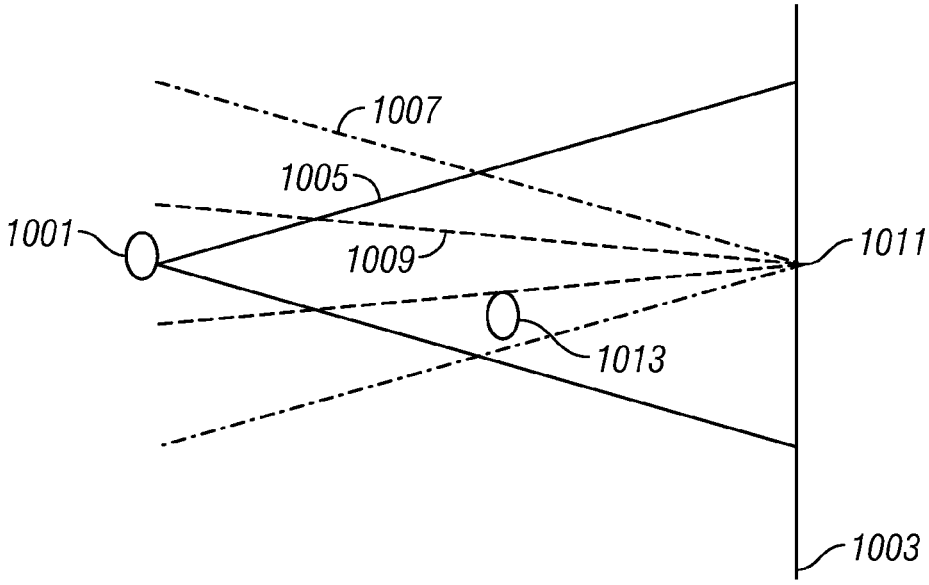
FIG. 10 illustrates the differences in beam width and resolution of the fundamental and second harmonic signals.
Figure 11:
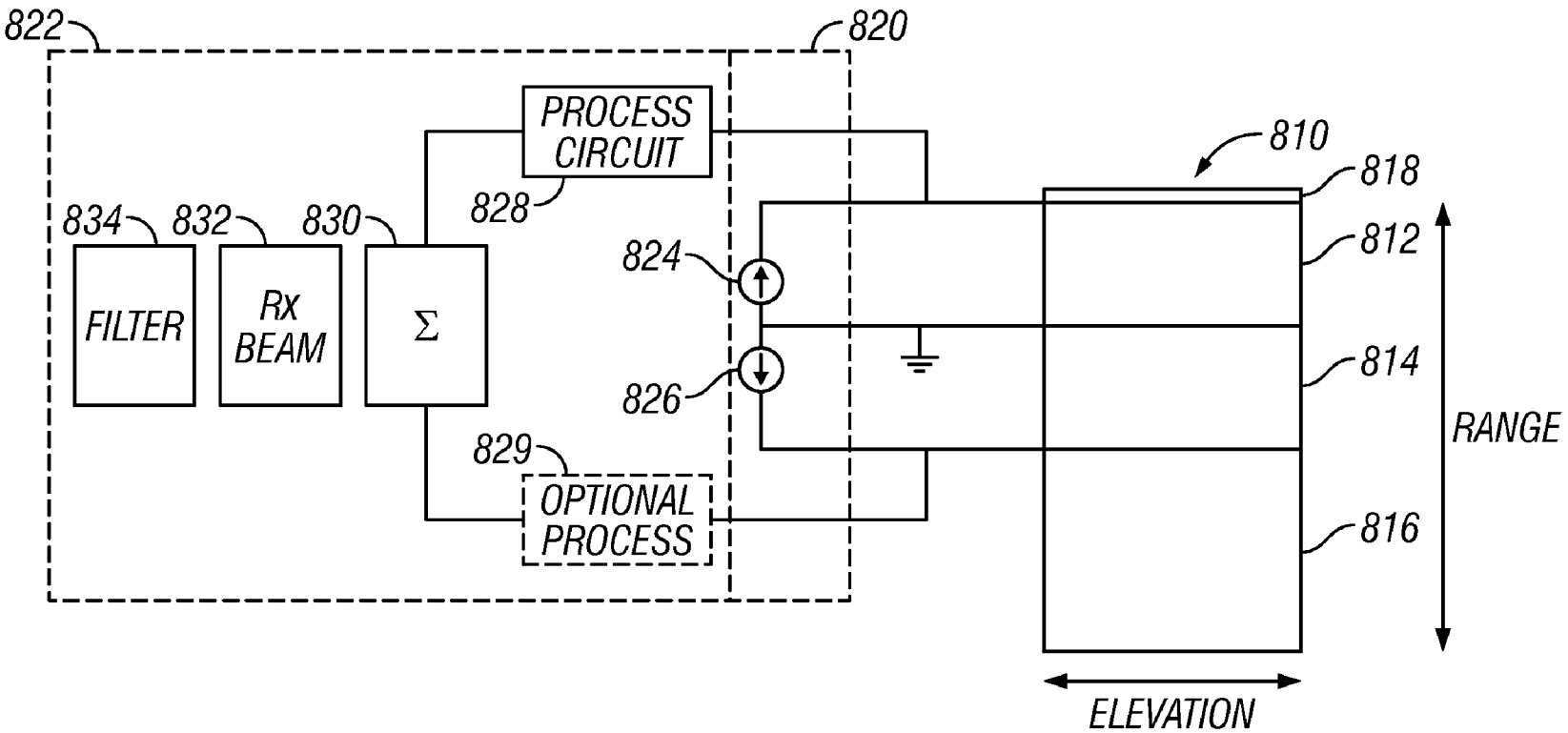
Figure 11 (Prior Art)
FIG. 11 (prior art) shows is a block diagram of one embodiment of a medical diagnostic ultrasound transducer system.

The present disclosure also takes advantage of the fact that the resolution and beam width at the fundamental frequency is different from that for the harmonics and the subharmonics. FIG. 10 illustrates the concept A source transducer 1001 emits a signal at a fundamental frequency with a characteristic beam width 1005. Upon reflection from a point such as 1011 on a reflector 1003, the reflected beam at the fundamental frequency 1007 has the same beamwidth (and resolution) as the generated signal. However, the second harmonic reflection has a higher resolution and smaller beam size indicated by 1009. What this means is that the point 1011 would be better easier to detect (imaged) at the harmonic frequency in the presence of an obstruction 1013 that is within the beam 1009 (such as a drill cutting) than at the fundamental frequency.

Similarly, situations may exist where portions of the borehole wall are completely in the shadow of a large drill cutting at the fundamental frequency, but may still be imaged at a subharmonic frequency, albeit with relatively poor resolution.

Thus, the present disclosure envisages use of multifrequency acquisition. Using multi-frequencies allows obtaining borehole profile with multi-resolution. Low frequency will be used for extended range, and higher frequency will be use for shorter range. In addition the harmonics of the transmitted frequency will be utilized at the receiver to obtain higher resolution borehole profile using low frequency transmitted signal. An ultrasonic pulse is composed of a group of frequencies which define their spectral contents. Harmonic frequencies occur at integer multiples of the fundamental frequency, just like the second harmonic occurring at twice the fundamental frequency. The second harmonic signals have the narrower beam widths and lower levels of the sidelobes than the fundamental signal. Furthermore, the third harmonic signal exhibits the narrower and lower side-lobe levels than those of the second harmonic signal. Achieving high bandwidth at the fundamental transmitted frequency and simultaneously achieving high bandwidth at the harmonic frequency during the receive operation can be achieve using a dual layer transducer system in which the effective polarity of the two layers is switched between transmit and receive. A single frequency transducer will be excited with its fundamental frequency, and its harmonic (third, and fifth), or a broadband transducer will be excited with multi-frequencies. The transducer will receive every transmitted frequency and its harmonics and subharmonics.

With the present disclosure, it is thus possible to estimate a standoff of the FE sensor at each depth and each rotational angle of the sensor during drilling of the borehole. This can be used to obtain more accurate estimates of the formation properties using known correction methods. These include, for example, the spine and rib corrections made with nuclear measurement, adjustment of NMR acquisition sequences based on standoff measurements (see U.S. Pat. No. 7,301,338 to Gillen et al), photoelectric factor (see US 2008/0083872 of Huiszoon). As discussed above, the method of the present disclosure estimates both of these quantities as a function of depth and the tool rotational angles.

The toolface angle measurements may be made using a magnetometer on the BHA. Since in many situations, the FE sensor and the magnetometer may operate substantially independently of each other, one embodiment of the present disclosure processes the magnetometer measurements and the FE sensor measurements using the method described in U.S. Pat. No. 7,000,700 to Cairns et al., having the same assignee as the present disclosure and the contents of which are incorporated herein by reference.

Those versed in the art and having benefit of the present disclosure would recognize that many aspects of the method may be practiced without the necessity of a rotating acoustic transducer. U.S. Pat. No. 5,640,371 to Schmidt et al, having the same assignee as the present disclosure and the contents of which are incorporated herein by reference, discloses a method and apparatus for acoustically logging earth formations surrounding a bore hole containing a fluid, by use of a downhole logging instrument adapted for longitudinal movement through the bore hole. An acoustic transducer assembly is provided within the logging instrument and incorporates a cylindrical array of piezo-electric elements with the array being fixed within the housing structure. The method according to the preferred embodiment of this invention employs the use of mechanical and electronic beam focusing, electronic beam steering, and amplitude shading to increase resolution and overcome side lobe effects. The method introduces a novel signal reconstruction technique utilizing independent array element transmission and reception, creating focusing and beam steering. The transducers disclosed in Schmidt may be replaced by the harmonic transducers discussed above. The beam-steering can be used to provide acoustic measurements at a plurality of azimuthal angles that can then be processed in a manner similar to measurements made with a rotating transducer.

The processing of the data may be done by a downhole processor and/or a surface processor to give corrected measurements substantially in real time. Implicit in the control and processing of the data is the use of a computer program on a suitable machine readable medium that enables the processor to perform the control and processing. The machine readable medium may include ROMs, EPROMs, EEPROMs, Flash Memories and Optical disks. Such media may also be used to store results of the processing discussed above.

What is claimed is:

1. A method of evaluating an earth formation, the method comprising:

conveying an acoustic sensor on a downhole assembly into a borehole;

making measurements at a plurality of azimuthal angles of a distance to a wall of the borehole, the measurements including measurements at least one of: (I) a harmonic of a fundamental frequency of the acoustic sensor, and (II) a subharmonic of a fundamental frequency of the acoustic sensor; and processing the measurements to estimate a geometry of the borehole.

2. The method of claim 1 further comprising using a measurement of the distance to the borehole wall and the estimated geometry of the borehole to estimate a location of the downhole assembly in a cross-section of the borehole.

3. The method of claim 1 wherein making measurements at the plurality of azimuthal angles further comprises at least one of: (i) rotating the acoustic sensor, and (ii) using a beam steering of the acoustic sensor.

4. The method of claim 1 further comprising:

(i) estimating a standoff of a formation evaluation (FE) sensor on the downhole assembly, (ii) making measurements of a property of the formation with the FE sensor on the downhole assembly, and (iii) estimating a value of the property of the earth formation using the estimated standoff and the measurements made by the FE sensor.

5. The method of claim 1 further comprising using the measurements for identifying a drill cutting in the borehole.

6. The method of claim 1 further comprising providing an image of the borehole wall.

7. The method of claim 1 further comprising at least one of:

(i) providing a 3-D view of the borehole, and (ii) identifying a washout.

8. The method of claim 1 further comprising selecting the fundamental frequency of the acoustic sensor based at least in part on a density of a fluid in the borehole.

9. An apparatus for evaluating an earth formation, the apparatus comprising:

a downhole assembly configured to be conveyed into a borehole;

an acoustic sensor on the downhole assembly being configured to make measurements at a plurality of azimuthal angles of a distance to a wall of the borehole;

at least one processor configured to:

(I) recover from the measurements a signal including at least one of: (A) a harmonic of a fundamental frequency of the acoustic sensor, and (B) a subharmonic of a fundamental frequency of the acoustic sensor; and (II) use the recovered signals to estimate a geometry of the borehole.

10. The apparatus of claim 9 wherein the at least one processor is further configured to use a measurement of the distance to the borehole wall and the estimated geometry of the borehole to estimate a location of the downhole assembly in a cross-section of the borehole.

11. The apparatus of claim 9 further comprising a formation evaluation (FE) sensor on the downhole assembly configured to make measurements of a property of the formation at the plurality of azimuthal angles;

wherein the at least one processor is further configured to:

(i) estimate a standoff of the formation evaluation (FE) sensor, and (ii) estimate a value of the property of the earth formation using the estimated standoff and the measurements made by the FE sensor.

12. The apparatus of claim 9 wherein the at least one processor is further configured to use the measurements to identify a drill cutting in a fluid in the borehole.

13. The apparatus of claim 9 wherein the at least one processor is further configured to provide an image of the distance to the borehole wall.

14. The apparatus of claim 9 wherein the at least one processor is further configured to at least one of: (i) provide a 3-D view of the borehole, and (ii) identify a washout.

15. The apparatus of claim 9 wherein the acoustic sensor further comprises a plurality of layers having a different acoustic impedance.

16. The apparatus of claim 9 wherein the downhole assembly is selected from: (i) a bottomhole assembly configured to be conveyed on a drilling tubular, and (ii) a logging string configured to be conveyed on a wireline.

17. The apparatus of claim 9 wherein the acoustic sensor is configured to make measurements at the plurality of azimuthal angles by at least one of: (i) rotation of the sensor, and (ii) beam-steering of the sensor.

18. A tangible computer readable medium product having stored thereon instructions that when read by a processor cause the processor to perform a method, the method comprising:

process measurements made by an acoustic sensor on a downhole assembly in a borehole to recover a signal including at least one of: (A) a harmonic of a fundamental frequency of the acoustic sensor, and (B) a subharmonic of a fundamental frequency of the acoustic sensor; and process the recovered signals to estimate a geometry of the borehole.

19. The medium of claim 18 further comprising at least one of: (i) a ROM, (ii) an EPROM, (iii) an EEPROM, (iv) a flash memory, and (v) an optical disk.

* * * * *